US006434783B1

(12) United States Patent
Arnold et al.

(10) Patent No.: US 6,434,783 B1
(45) Date of Patent: Aug. 20, 2002

(54) VACUUM SYSTEM FOR PRE-WASH REMOVAL OF FOOD/GREASE MATERIALS IN DISHWASHER FACILITIES

(76) Inventors: Mark Arnold, 6310 S. Maxwelton Rd., Clinton, WA (US) 98236; Kenneth C. Turner, 309 Russell Rd., Camano Island, WA (US) 98292

( * ) Notice: Subject to any disclaimer, the term of this patent is extended or adjusted under 35 U.S.C. 154(b) by 0 days.

(21) Appl. No.: 09/350,633

(22) Filed: Jul. 9, 1999

(Under 37 CFR 1.47)

Related U.S. Application Data

(60) Provisional application No. 60/092,317, filed on Jul. 9, 1998.

(51) Int. Cl.[7] ..... A47L 5/38
(52) U.S. Cl. ..... 15/301; 15/302; 15/409
(58) Field of Search ..... 15/301, 310, 314, 15/302, 409

(56) References Cited

U.S. PATENT DOCUMENTS 1,986,476 A * 1/1935 Ironside ..... 15/409 X
2,071,975 A * 2/1937 Holm-Hansen et al. .... 15/327.1 X
2,093,748 A * 9/1937 Becker ..... 15/353
2,863,525 A * 12/1958 Lucian ..... 15/409 X
3,971,096 A * 7/1976 Renholt ..... 15/409 X
4,641,392 A * 2/1987 Huisma ..... 15/302
5,142,730 A * 9/1992 Braks et al. ..... 15/409 X
5,970,573 A * 10/1999 Lahaye ..... 15/353 X
6,055,701 A * 5/2000 Grey et al. ..... 15/353 X

* cited by examiner

*Primary Examiner*—Chris K. Moore

(57) ABSTRACT

A method and apparatus for reducing food and grease in a wastewater stream from a food service facility. Vacuum is supplied to a suction hose, which is used to remove food and grease from plates and utensils prior to these being introduced into the water flow. The food and grease is collected in a waste container for separate disposal. The suction hose may be fitted with a scrubber head for breaking up and removing the materials. The vacuum may be supplied by an air pressure operated vacuum transducer, or by an exhaust blower. The invention thus solves the problem of high BOD, FOG and TSS levels in wastewater streams from food service facilities, which generate excessive loads on both on-site septic systems and municipal waste water treatment plants.

10 Claims, 2 Drawing Sheets

VACUUM SYSTEM FOR PRE-WASH REMOVAL OF FOOD/GREASE MATERIALS IN DISHWASHER FACILITIES

This application claims benefit of No. 60/092,317 filed Jul. 9, 1998.

BACKGROUND a. Field of the Invention

The present invention relates generally to residential/commercial waste water systems, and, more particularly, to a system for removing oil, grease, food and other materials from cookware/servingware and utensils prior to these being introduced into the waste water stream.

b. Prior Art

Residential and commercial waste water streams are commonly treated by either on-site (e.g., septic systems) or municipal waste water systems. In both instances, the waste water is subjected to some form of aerobic and/or anaerobic biological treatment, in order to render the constituents of the waste stream safe prior to being discharged into the environment.

The efficacy of the biological treatment processes utilized in these systems are quite sensitive to levels of certain constituents in the waste stream. In particular, with respect to the present invention, significant components of the waste stream include the following:

(1) Fats, Oils and Grease (referred to herein as "F.O.G.");

(2) Biochemical Oxygen Demand (referred to herein as "B.O.D."), which is directly related to the levels of undigested food present in the waste stream;

(3) Total Suspended Solids (referred to herein as "T.S.S."), which includes levels of both food and human waste; and (4) Fecal Bacteria Count (referred to herein as "FECAL").

While most residential waste water streams have F.O.G., B.O.D., T.S.S., and FECAL levels which are within acceptable limits, restaurants and other commercial/institutional food service operations (referred to collectively herein as "food service establishments") often produce waste water streams which far exceed acceptable limits in one or more of these categories.

In particular, food service establishments tend to introduce very high levels of grease and undigested food into the waste water stream via the kitchen sink, into which these materials are flushed from pots, pans, dishes and utensils prior to being washed. For example, in a typical food service establishment, the first step in the dishwashing process is to quickly scrape the largest pieces of uneaten food into a trash can, and then rinse the plates/utensils off using a spray nozzle before placing them in the wash sink or in a mechanical dishwasher. The intended purpose of the initial. scraping step is to reduce the amount of large-sized food solids which are flushed down the drain (mostly in an effort to prevent clogging), but in fact manual scraping is grossly inefficient and leaves very large amounts of food/grease on the cookware/servingware and utensils, thus necessitating the preliminary rinse step. Moreover, food service establishment dishwasher personnel are often poorly paid and constantly harried to work faster, with the result that the initial scraping is often cursory at best.

As a result, food service establishment waste water streams are commonly characterized by F.O.G., B.O.D., and T.S.S. levels which far exceed acceptable limits. For example, many food service establishments having on-site waste water treatment systems (usually, a septic tank and drain field) are required by regulation to maintain waste water streams within parameters such as the following:

| | |
|---|---|
| F.O.G. | 40 ppm |
| B.O.D | 230 ppm |
| T.S.S. | 145 ppm |

In fact, because of the problems noted above, the following waste water test results are more typical for a commercial restaurant operation:

| | |
|---|---|
| F.O.G. | 3,000 ppm |
| B.O.D. | 21,000 ppm |
| T.S.S. | 3,900 ppm |

As can be seen, these levels exceed acceptable parameters by up to 100 times, which means that not only is such a restaurant operating well out of regulatory limits for an on-site treatment system, but in fact the drain field and other components of such a system will be rendered inoperable in a comparatively short time, necessitating extremely expensive repairs. This problem is aggravated by the large amount of water which is used to rinse the plates/utensils, which not only increases the water bills for the facility, but can also lead to excessive hydraulic loading of the septic system.

Municipal waste water treatment systems (i.e., sewer systems) also typically require food service establishments to maintain F.O.G., B.O.D., and T.S.S., levels within certain, comparable limits, since high levels of these components will similarly impair the operation of municipal sewage plants and impact their ability to discharge effluent which is within environmentally acceptable limits. As a result, the waste water streams of food service establishments are routinely tested by municipalities to ensure that they are within specified limits, and if the limits are exceeded the establishment may be subjected to fines and/or surcharges to compensate the municipality for the additional costs involved in treating the material.

For these reasons, many restaurant and other food service establishment operators have had to install complicated and expensive systems in an effort to remove food and grease from their waste water streams. For example, many restaurants and other food service establishments have installed very costly waste water grease collection and trap systems. Under ideal operating conditions, many of these systems are capable of removing up to 98% of the grease from the waste water. Unfortunately, proper operation of these systems is, as a rule, highly sensitive to the levels of food and particulate material in the waste stream; in other words, the grease extractor systems are capable of effectively removing grease/oil from the waste water streams, but only if virtually all of the food is scraped off of the plates/utensils before they are rinsed or washed. For the reasons discussed above, however, it is the rare exception that the plates/utensils are scraped completely clean before they are introduced into the water stream, with the result that grease extractors systems installed at food service establishments almost invariably require high levels of maintenance, and are often clogged or otherwise rendered inoperative by high food levels in the waste water. Moreover, even when grease extractor systems are functioning properly, they are very expensive to service and maintain, since special facilities are required for disposal of the collected material and servicing cannot be performed by conventional septic tank pumping companies.

In some extreme instances, restaurants and other food service establishments using on-site waste water treatment systems have been forced to construct much larger treatment systems in order to handle the high F.O.G., B.O.D., and T.S.S. loads produced by their operations. Because of the space limitations common in restaurants and other commercial operations, many of these enlarged waste water systems must be located "off-site" at a remote locations which are capable of accommodating the much larger drain fields. This involves extreme expense, in purchasing the additional real estate, laying piping to the remote site, and installing the additional drain field. Such costs are simply beyond the reach of many food service establishments, especially independent restaurant operations, which are then faced with the prospect of having to close down the business.

Accordingly, there exists a need for an apparatus which can be used to reduce F.O.G., B.O.D., and T.S.S. levels in food service establishment waste water streams to within acceptable levels. Furthermore, there exists a need for such an apparatus which will reduce or eliminate the necessity for any pre-wash rising of plates and utensils, so as to reduce the total amount of water which is used in the washing process. In addition, there exists a need for such an apparatus which is sufficiently effective and convenient to use that it will be employed effectively by food service establishment kitchen personnel. Still further, there exists a need for such an apparatus which is sufficiently inexpensive to be economically available to the majority of food service establishment operations, and which is also reliable and inexpensive to maintain. Still further, there exists a need for such an apparatus which is safe and sufficiently quiet for use in a kitchen facility, which is commonly located adjacent the dining area of the food service establishment.

SUMMARY OF THE INVENTION

The present invention has solved the problems cited above, and is an apparatus for pre-rinse removal of food and grease from cookware, serving ware and utensils.

The apparatus includes a suction line having an intake end for dislodging and removing the food/grease from the dishes and utensils, at a discharge end from which the food/grease is discharged into a solid waste container. The intake end of the suction tube may be provided a scrubbing head having a plurality of bristles for breaking up and dislodging the food and grease.

The vacuum may be applied to the suction line by means of an air pressure operated, venturi-type pump. The venturi-type pump may be an air operated vacuum transducer, which generates the vacuum in response to a flow of high pressure air therethrough. Alternatively, the vacuum may be provided by a blower via a vacuum line which is connected to the waste container.

The present invention also provides a method for reducing the load of food and grease on a kitchen waste water flow. The method may comprise the steps of applying a vacuum to the plates and utensils so as to remove the food and grease before they are introduced into the waste water flow. The food and grease are collected in a waste container and disposed of separately.

DETAILED DESCRIPTION

Figure 1:
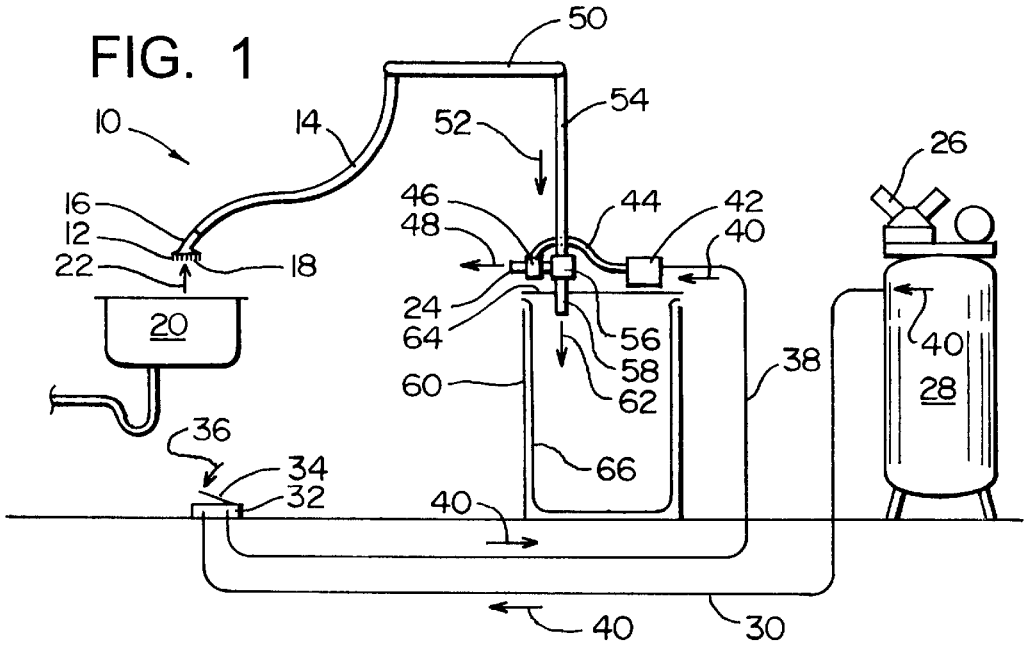
FIG. 1 is an elevational, somewhat schematic view of a pre-wash food/grease removal apparatus in accordance with a first embodiment of the present invention, showing the major components thereof.

FIG. 1 shows a pre-wash food/grease removal system 10 in accordance with the present invention.

The present invention removes the food and grease from the plates and utensils prior to the subsequent washing steps (as used herein, the term "plates" includes all forms of serving ware and cookware), thereby preventing the food and grease entering the waste water stream to begin with. By thus reducing the amount of food/grease which is introduced into the waste water stream, the need for a down-stream grease extractor or other form of trap is greatly reduced or eliminated: in some instances, the levels may be sufficiently reduced that there is no need for any down-stream grease removal apparatus, and in other instances the food/particulate levels may be reduced sufficiently to allow a downstream grease extractor to operate efficiently and reliably. In either instance, the present invention serves to reduce the F.O.G., B.O.D. and T.S.S. levels in the waste water stream to acceptable levels, enabling the food service establishment to avoid or eliminate the problems discussed above.

The present invention operates by applying a vacuum to the surface of the plate or utensil, thereby removing the food and grease thereon and routing this to a solid waste disposal container. As can be seen in FIG. 1, the vacuum is supplied to a scrubbing head 12 via a large-diameter, flexible vacuum hose 14. The scrubbing head includes body having a grip portion 16 and a suction face 18 having a plurality of short (e.g., one-quarter inch) bristles arranged about a large-diameter suction opening (not shown). The suction head is positioned above a pre-rinse sink 20, so that the operator is able to hold the plates and utensils over the sink while "vacuuming" food and grease into the flexibly supported suction head, as indicated by arrow 22 in FIG. 1.

The suction hose 14 and associated tubing is provided with a diameter which is sufficiently large to permit free passage of fairly large pieces of solid food therethrough, along with more fluid materials, while still maintaining a fairly strong suction; for example, a one and one half inch diameter flexible suction hose has been eminently suitable for this purpose.

In the embodiment which is shown in FIG. 1, the vacuum is applied to the suction hose by means of a pneumatically operated vacuum transducer 24, the operation of which will be described in greater detail below. High pressure air for operating the transducer is supplied from a compressor 26 and air storage tank 28, through high pressure supply line 30. The discharge end of the supply line 30 is connected to a remote, foot-operated, air control valve 32; various models of suitable foot-operated air control valves are available from suppliers of conventional pneumatic controls.

The operator actuates the control valve 32 by applying foot pressure to the pedal switch 34, as indicated by arrow 36 in FIG. 1. This action opens the control valve, so that air pressure is supplied from the first high pressure air line 30 to a second high pressure air line 38, in the direction indicated by arrows 40 in FIG. 1. The use of pneumatic control valve in the embodiment, as opposed to a solenoid or similar device, obviates the need for an electrically operated foot switch, avoiding potential safety hazards and building code problems relating to the use of electrical devices in a sopping wet kitchen environment.

The high pressure from line 38 passes through an on-off control 42 which is actuated by means of the remote foot valve. High pressure air is fed from the control box, via a short connection line 44, to the HP air attachment 46 on the vacuum transducer. As will described in greater detail below, the high pressure air enters the body of the transducer and exits from the exhaust in the direction indicated by arrow 48, creating a powerful vacuum in suction hose 14.

The vacuum draws the food and grease through the vacuum hose and associated tubing 50, in the direction indicated by arrow 52 in FIG. 1. A final leg of the suction tubing 54 is mounted to extend vertically, in generally co-axial alignment with the vacuum "T" and discharge tube 58. As a result, the food/grease which is passing through the vacuum tube is accelerated in a vertical, downward direction as indicated by arrow 52, so that it passes vertically through the "T" fitting and discharge tube into the solid waste container 60, as indicated by arrow 62, while the bulk of the air is exhausted laterally through the vacuum transducer in the direction indicated by arrow 48. In some embodiments, a deflector or baffle may be provided at the "T" fitting to further ensure that no solid or liquid waste enters the transducer tube.

The solid waste container 60 can suitably be a conventional plastic or metal garbage can with a removable lid 64, preferably fitted with an ordinary plastic garbage can liner 66 for sanitary purposes. Because most of the air is exhausted through the vacuum transducer and only food/grease is ejected or "shot" into the solid waste container, very little excess vacuum or pressure is exerted on the interior of the garbage can, thereby avoiding the need for a specially sealed or reinforced container. To prevent "blow-by" and excessive escape of odors, however, the lid 64 may be attached to the container using small, conventional clamps (not shown).

Figure 2:
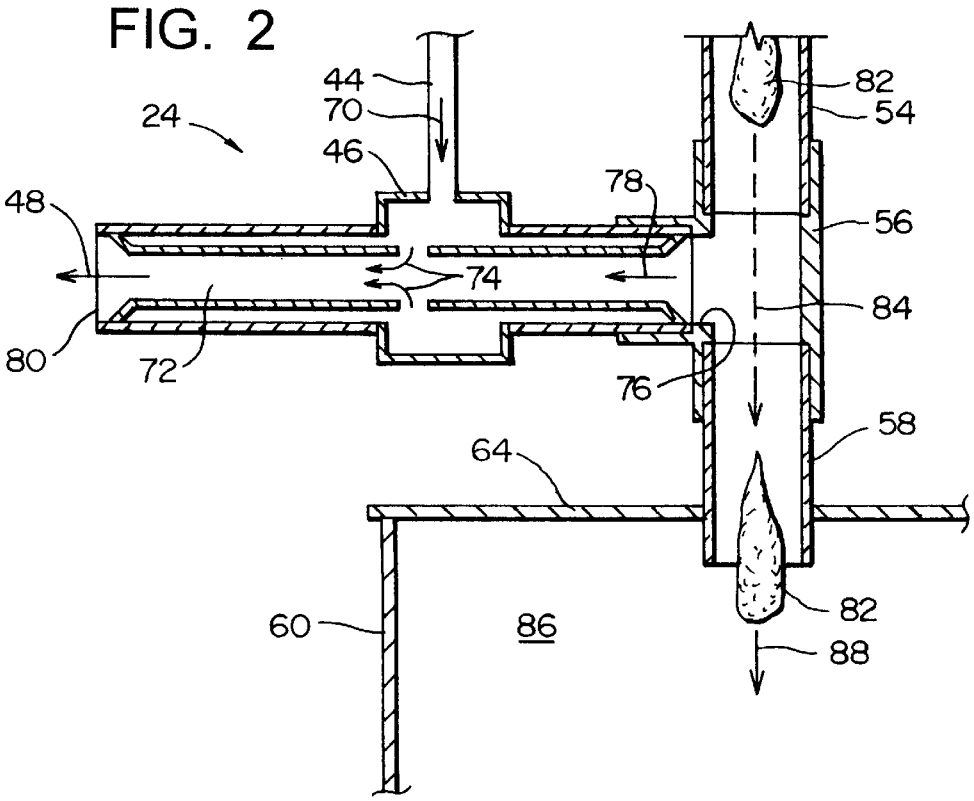
FIG. 2 is an enlarged, elevational view of the vacuum transducer assembly of the apparatus of FIG. 1.

The operation of the vacuum transducer 24 is shown in greater detail in FIG. 2. It will be understood that the vacuum transducer is an "off-the-shelf" component (e.g., suitable examples include DF series vacuum transducer units, available from Vaccon Vacuum Products, Medfield, Mass., USA). Consequently, only an overview of the transducer will be provided here, for the purpose of providing a better understanding of the manner in which the present invention operates.

As can be seen in FIG. 2, the high pressure air enters the attachment fitting 46 of the vacuum transducer through line 44, in the direction indicated by arrow 70; when using a DF series Vaccon transducer of the type noted above, a supply pressure of about 150 PSI has been found eminently suitable. The compressed air is fed into an exterior ring that has a number of orifices which lead into the main tube 72 of the transducer. As compressed air exits from the orifices, as indicated by arrows 74, its velocity increases to supersonic speeds, and the air which is forced into the center of the tube develops a twisting motion somewhat resembling that of a worm screw. This cyclonic flow creates a powerful vacuum through the transducer, drawing in air at the intake end 76 as indicated by arrow 78, and discharging air from the exhaust end 80 of the transducer as indicated by arrow 48. A vacuum transducer of the type described above has many advantages, especially in terms of efficiently providing rapid evacuation of a large volume of air to a low vacuum level; it will be understood, however, that other venturi-type pumps and other air operated vacuum pumps may also be used in various embodiments of the present invention.

The food, grease and other solid, semi-solid or liquid waste 82, having been accelerated in the vertical direction as described above, travels along a generally vertical, straight-line path past the intake end of the vacuum transducer, as indicated by dotted line 84 in FIG. 2, and is ejected into the interior 86 of the waste container as indicated by arrow 88. As a result, essentially no solid/liquid waste is drawn into the vacuum transducer, and only the air is discharged out the exhaust end 80 of the transducer. Moreover, the vacuum transducer has no moving parts, and consequently is not subject to being damaged or clogged by whatever dampness, vapors, or particles might pass through it with the air flow.

Yet another advantage provided by the air operated vacuum system is that the apparatus is extremely quiet in operation, the only noise generated by the system being a slight "hiss" when the pneumatic foot valve is actuated. This is a very significant advantage, since the kitchen/dishwashing area is often located adjacent the dining area of the food service establishment and high noise levels in this area are unacceptable to the diners. Moreover, the compressor can be located outside of the main building, where it will not be heard by the patrons, and the use of a reasonably large storage tank (e.g., an 80 gallon capacity) ensures that the compressor operates only intermittently, further minimizing the amount of noise which is generated.

The embodiment of the invention which is shown in FIGS. 1–2 has numerous advantages which have been noted above. The embodiment which is shown in FIGS. 3–4 has certain other advantages, primarily in terms of economy.

Figure 3:
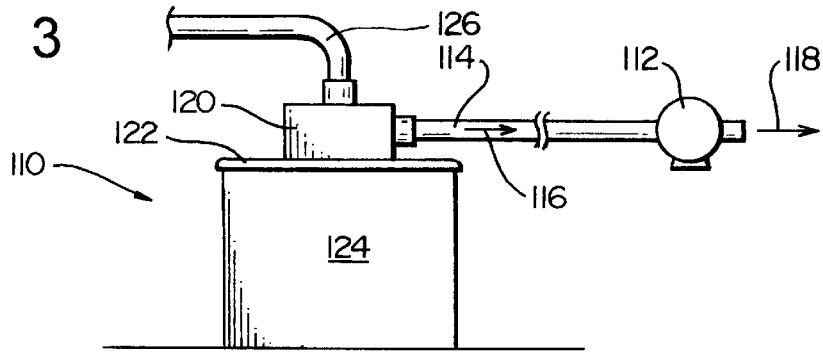
FIG. 3 is an elevational, somewhat schematic view of a pre-wash food/grease removal apparatus in accordance with a second embodiment of the present invention, the vacuum being supplied in this embodiment by means of a blower rather than a compressed air system.

In particular, the vacuum for the apparatus 110 shown in FIG. 3 is provided by a relatively high volume exhaust blower 112, as opposed to the air pressure operated transducer in the embodiment described above. The blower applies vacuum to an exhaust line 114, with the pressure side of the blower discharging to the atmosphere in the direction indicated by arrow 118. The principal advantage of the blower is that it is much less expensive than the air compressor which is used in the system described above. An acceptably low noise level can still be achieved by mounting the blower in remote location, such as on a roof or in a mechanical room, for example.

The intake end of the exhaust line 114 is connected to a vacuum assembly 120, which is mounted on a lid 122 which sealingly attaches to the upper end of a waste barrel 124 or other suitable waste container. The suction hose 126 for the waste, in turn, is attached to the upper end of the vacuum assembly 120, the other end of the hose being connected to a suction head in the same manner as described above. For ease of sanitation and durability, the barrel, lid and vacuum assembly are suitably constructed of stainless steel. Clamps (not shown) may be provided for attaching the lid to the top of the waste drum during use, and the drum itself may be provided with handles (not shown) for ease of handling.

Figure 4:
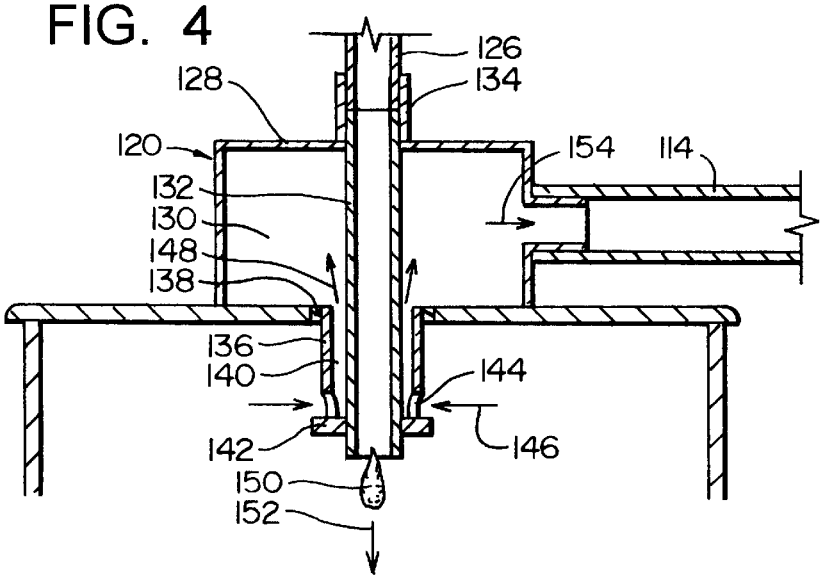
FIG. 4 is an enlarged, cross-sectional view of the vacuum assembly of the apparatus FIG. 3, showing the arrangement of inlet and exhaust tubes which apply vacuum to the waste container of the system.

As can be seen in FIG. 4, the vacuum assembly 120 includes a hollow, generally cylindrical housing 128 which forms a plenum chamber atop the waste drum, with the vacuum being applied to the plenum chamber via hose 114. The waste suction hose 126, in turn, attaches to a substantially straight section of pipe 132 which extends vertically through the interior of the plenum chamber and downwardly into the waste collection drum 124. A seal 134 is provided where the upper end of the pipe 132 extends through the wall of the plenum chamber, and a second, larger-diameter outflow pipe 136 is mounted concentrically around the lower end of the vertical pipe 132. A seal 138 is also formed around the outflow pipe, where this passes through lid 122, so as to maintain the integrity of plenum chamber 130.

As can be seen, the lower end of the outflow pipe extends downwardly into the interior of the waste collection drum in coaxial relationship with pipe 132, thereby forming an annular airflow passage 140 between the two members. The lower end of the outflow pipe 136 butts up against a retainer ring 142 which is mounted to the lower end of the inside pipe 132. A plurality of radially disposed inlet ports 144 are formed about the bottom end of the outflow pipe 136, so as to establish fluid communication between annular passage 140 and the interior of the collection drum.

Thus, when vacuum is applied to the plenum chamber via exhaust line 114, air is drawn radially inwardly from the interior of the collection drum via ports 144, in the direction indicated by arrows 146. The air then passes upwardly through the annular passage 140 and enters the plenum chamber through the open upper end of pipe 136, in the direction indicated by arrows 148. This outflow of air in turn applies a powerful vacuum to suction line 126, for removing food and grease from dishes and utensils in the manner described above.

As the waste 150 enters the collection container, it is accelerated in a vertical direction through pipe 132 and is discharged from the lower end thereof, in the direction indicated by arrow 152. The vertical acceleration of the waste helps to ensure that this is deposited directly in the bottom of the container with a minimum of dispersal. The radial alignment of the intake ports at the upper end of the container, in turn, helps to minimize the amount of waste material which is drawn into the vacuum assembly with the outgoing air; to further reduce the amount of particulate material entering the vacuum assembly, an annular sponge filter (not shown) or other suitable filter can be mounted over the intake ports, around the bottom of the outflow pipe 136.

After the exhaust air enters the plenum chamber 130, additional settling and changes in direction occur before the airflow enters the exhaust line 114, in the direction indicated by arrows 154, thus allowing additional particulate material to drop out of the airflow so that these are prevented from entering the exhaust line. This serves to minimize the amount of particulate food material passing through blower 112, thereby reducing the need for cleaning and servicing of the blower.

Figure 5:
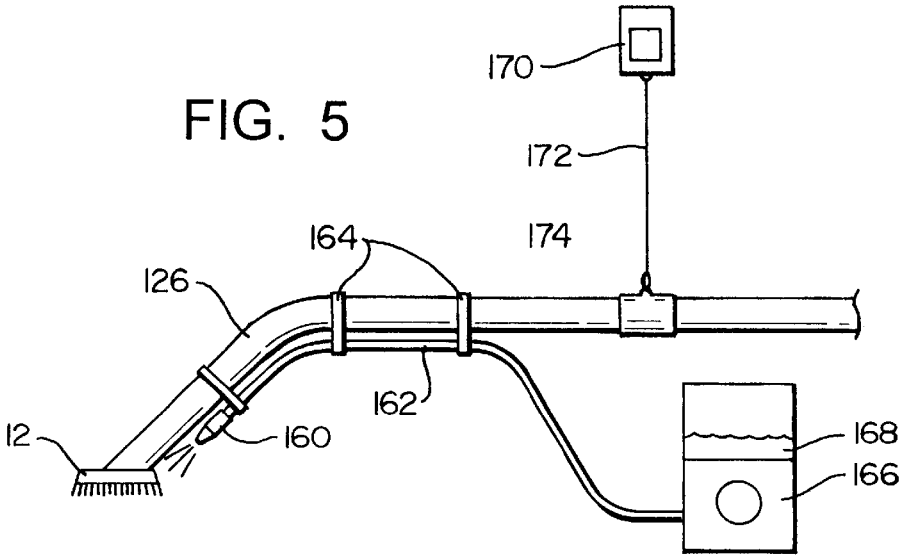
FIG. 5 is an elevational, somewhat schematic view of the intake end of the vacuum hose of an apparatus in accordance with the present invention, showing this fitted with a nozzle for spraying liquid soap or other material onto the utensils, and a pull-down switch for automatic actuation of the vacuum source.

FIG. 5 shows attachments which are optionally provided for enhancing the operation of the system of the present invention. Firstly, as can be seen, the intake end of the waste suction hose 126 may be fitted with a nozzle 160 for dispensing soap, liquid enzymes, or other fluid onto the plates and utensils as these are being scrubbed with the suction head 12. This liquid can be used to help break up and free the food and grease from the plates and utensils, and may also be used to enhance subsequent washing of the dishes. The liquid is supplied under pressure via a small diameter flexible tube 162 which is attached alongside the main suction line using a series of straps 164 or other attachments. The inlet end of the tube is attached to an electrically operated dispensing pump 166 having a supply of the soap 168 or other liquid material.

Thus, the operator is able to freely maneuver the scrubbing head and suction hose as necessary to remove the food waste, while simultaneously applying the spray of soap or other liquid material immediately adjacent to the head, where it will have the greatest effect.

FIG. 5 also shows a "pulldown" switch 170 which is attached via tensioned cable 172 to a saddle 174 or other suitable fitting which is mounted to suction hose 126. Thus, the blower 112 (see FIG. 3) or other vacuum source can be actuated automatically when the dishwasher or other operator pulls downwardly on the hose to begin using it. Furthermore, the switch 170 can be set to have a delayed shutoff (e.g. a 3-minute delayed shutoff), so that the operator can temporarily release the hose to get additional dishes or otherwise move around the kitchen without having the system shut off and energize each time. For enhanced safety, the pulldown switch 170 may be operated on 24 volt current, as may other electrical switches in the system which may be exposed to water.

The apparatus of the present invention thus provides an extremely quick and efficient method for pre-rinse removal of food and grease from dishes and utensils, vastly reducing the amounts of these materials which are introduced into the waste water stream. Moreover, the system is actually quicker and more convenient than the traditional approach of scraping food/grease off of plates and utensils, so that it actually eases the work of dishwasher personnel; consequently, it is well received and readily used by workers. The net result is that the apparatus is extremely effective in reducing the F.O.G., B.O.D. and T.S.S. figures to acceptable levels, even in a large food service establishment kitchen. Furthermore, by reducing or eliminating the need for any pre-wash rinsing of the dishes and utensils, the total amount of water required for the washing process is greatly reduced; not only does this represent savings in water consumption costs, but the lower water usage also alleviates hydraulic loads on septic systems. Still further, in some instances the greatly reduced B.O.D., F.O.G. and T.S.S. levels, in combination with the reduced hydraulic loads, may permit the food service establishment to operate using especially compact, efficient forms of on-site treatment systems (e.g., certain types of proprietary or "package" systems) which would not otherwise be suitable for such a facility.

It is to be recognized that various alterations, modifications, and/or additions may be introduced into the constructions and arrangements of parts described above without departing from the spirit or ambit of the present invention.

What is claimed is:

1. A system for capturing food and grease from being entrained in a flow of wastewater from a food service facility, said apparatus comprising:

a sink defining a cleaning region for dishware, utensils and other food related items possibly having food and/or grease thereon;

a flexible suction hose;

a suction head mounted on an end of said hose and positioned for engaging said dishware utensils and other food related items at said sink so as to receive food and grease therefrom prior to said plates and utensils being introduced into said flow of wastewater;

a vacuum source for applying vacuum to said hose so as to draw said food and grease into said hose; and a waste container for collecting said food and grease which is drawn into said hose, so that said food and grease are collected for disposal without being introduced into said flow of waste water.

2. The system of claim 1, wherein said vacuum source comprises:

an air pressure operated, venturi-type pump.

3. The system of claim 2, wherein said air pressure operated, ventrui-type pump comprises:

an air pressure operated vacuum transducer.

4. The system of claim 1, wherein said vacuum source comprises:

an exhaust blower.

5. The system of claim 4, wherein said waste container comprises a waste drum having an open upper end, and the vacuum source comprises a vacuum assembly which is sealingly mountable to said upper end of said waste drum.

6. The system of claim 5, wherein said vacuum assembly comprises:

a generally downwardly extending inflow pipe section mounted to a discharge end of said suction hose for accelerating said food and grease in a downward direction as said food and grease enter said container, so as to minimize the possibility of said food and grease passing into a flow of exhaust air from said container; and a generally downwardly extending outflow pipe section mounted in coaxial relationship with said inflow pipe section and extending downwardly into an interior of said waste container so as to form an annular passage between said pipe sections for said flow of exhaust air;

said annular passage between said pipe sections being connected to said vacuum source so as to communicate said vacuum to said interior of said waste container.

7. The system of claim 6, wherein said inflow pipe comprises:

an open lower end for generally axial discharge of said food and grease in a downward direction.

8. The system of claim 7, wherein said coaxially mounted outflow pipe section comprises:

at least one inlet port formed in a lower end of said outflow pipe section so as to extend laterally therefrom.

9. The system of claim 7, wherein said coaxially mounted outflow pipe section comprises:

a plurality of inlet ports formed in a lower end of said outflow pipe section so as to extend radially therefrom.

10. The system of claim 1, wherein said waste container comprises:

a downwardly extending pipe section mounted to a discharge end of said suction hose for accelerating said food and grease in a downward direction as said food and grease enter said container, so as to minimize the possibility of said food and grease passing into a flow of exhaust air from said container.

* * * * *